United States Patent [19]

Mori et al.

[11] Patent Number: 4,653,103

[45] Date of Patent: Mar. 24, 1987

[54] LOUDSPEAKER STRUCTURE AND SYSTEM

[75] Inventors: Tohru Mori; Makoto Kohashi, both of Kanagawa; Yoshio Ariki, Yokohama, all of Japan

[73] Assignee: Hitachi, Ltd., Tokyo, Japan

[21] Appl. No.: 826,249

[22] Filed: Feb. 5, 1986

[30] Foreign Application Priority Data

Feb. 8, 1985 [JP] Japan ..... 60-21653

[51] Int. Cl.[4] ..... H04R 9/00

[52] U.S. Cl. ..... 381/99; 381/117; 381/196; 381/203

[58] Field of Search ..... 381/99, 117; 179/115.5 PV

[56] References Cited

U.S. PATENT DOCUMENTS

| | | | |
|---|---|---|---|
| 4,081,627 | 3/1978 | Crist | 179/115.5 PV |
| 4,237,340 | 12/1980 | Klipsch | 381/99 |
| 4,242,541 | 12/1980 | Ando | 179/115.5 PV |
| 4,468,530 | 8/1984 | Torgeson | 179/115.5 PV |

*Primary Examiner*—Gene Z. Rubinson
*Assistant Examiner*—L. Schroeder
*Attorney, Agent, or Firm*—Antonelli, Terry & Wands

[57] ABSTRACT

In a planar loudspeaker structure comprising planar membrane for forming a diaphragm on which a voice coil of a conductor pattern is formed, and a magnetic circuit for supplying a DC magnetic flux which crosses the voice coil, the conductor pattern includes first and second zigzag conductor pattern portions which are juxtaposed on substantially the entire area of the membrane and connected in series. Opposite ends of the series connection of the first and second conductor pattern portions are respectively connected to first and second terminals for receiving a low-band component of an input audio signal. A high-band component of the input signal is applied to a third terminal connected to a junction between the first and second conductor pattern portions and supplied only to the second conductor pattern portion. The voice coil having the first and second zigzag conductor pattern portions is driven in a multi-drive fashion by driving forces which are weighted relative to each other so as to provide a flat sound pressure/frequency characteristic and a flat electrical impedance characteristic. In addition, the radiation area of the diaphragm is partly weighted by the disposition of the first and second zigzag conductor pattern portions so that the entirety of the membrane is vibrated in a low band and a portion of the membrane is vibrated in a high band, thereby improving the directivity characteristic.

13 Claims, 21 Drawing Figures

FREQUENCY RESPONSE OF CROSSOVER

FREQUENCY RESPONSE OF CROSSOVER

LOUDSPEAKER STRUCTURE AND SYSTEM

BACKGROUND OF THE INVENTION

This invention generally relates to a loudspeaker having a diaphragm comprised of a resin film and a voice coil in the form of a conductor pattern which is formed on the resin film by etching or vapor deposition of a thin film or foil and more particularly, it is concerned with a loudspeaker structure having a diaphragm formed with a plurality of multi-layer voice coils, and a loudspeaker system having the loudspeaker structure and a dividing network associated therewith as its interface.

One type of loudspeaker using a resin film as a diaphragm and another type having a plurality of separate voice coils are known as will be explained later with reference to conventional examples. These types of loudspeaker have inherent advantages but are disadvantageous in that their working band, i.e., reproduction band is restricted.

A background underlying the present invention will first be described by way of example.

In recent years, a heat-proof synthetic resin film (hereinafter simply referred to as a film) has been available, and a loudspeaker has been manufactured which has a thin diaphragm or membrane prepared by bonding together the film and an aluminum foil, for example, and etching the aluminum foil to form a conductor pattern of voice coil. Advantageously, this type of loudspeaker has a light vibration member and can afford to exhibit a flat electrical impedance characteristic, thereby greatly improving transient characteristics as compared to conventional cone type and dome type loudspeakers.

On the contrary, as described in an article "Tweeter Using New Structure and New Material for Diaphragm", Audio Eng. Soc., Vol. 29, No. 10, '81 Oct, the lightness of the vibration member degrades flatness of sound pressure/frequency characteristics in such a manner that as the frequency increases, the sound pressure level increases, causing a disadvantage of occurrence of a bounce h as shown in FIG. 2.

The occurrence of bounce h is due to radiation impedance characteristics of the loudspeaker, especially, an X component of a radiation impedance $Z_r$ which varies with frequency as shown in FIG. 3.

The radiation impedance $Z_r$ is given by $$Z_r = \pi a^2 Z_o \left[ 1 - \frac{J_1(2ka)}{ka} + \frac{S_1(2ka)}{2(ka)^2} \right] \quad (1)$$

$$= R_r + jX_r \quad (2)$$

where $$R_r = \pi a^2 Z_o \left[ 1 - \frac{J_1(2ka)}{ka} \right], \quad (3)$$

$$X_r = \pi a^2 Z_o \frac{S_1(2ka)}{2(ka)^2}, \quad (4)$$

$J_1$ is a Bessel function, $S_1$ is a Struve function, a is an effective radius of the diaphragm, Zo is a characteristic impedance which is $Zo=\rho_o C$ where $\rho_o$ represents the density of air and C sound velocity, and k a wave number. The real term $R_r$ is called a radiation resistance and the imaginary term $X_r$ is called a radiation reactance and within a frequency band represented by ka<1, there terms approximate, $$R_r = \pi a^2 Z_o \frac{(ka)^2}{2} = \frac{\pi a^4 Z_o}{2C} \omega^2 \quad (5)$$

and $$X_r = \pi a^2 Z_o \frac{8ka}{3\pi} = \frac{8a^3 Z_o}{3C} \omega \quad (6)$$

where k denotes the wave number which is $\omega/C$ or $2\pi/\lambda$, $\lambda$ a wavelength, $\omega$ an angular frequency which is $2\pi f$, and f a frequency.

In spite of the fact that, in many applications, the loudspeaker using the film is rectangular, the loudspeaker described herein is assumed to be a piston disc in an infinite baffle for simplicity of explanation.

Assuming that $X_r$ is represented by $$X_r = \omega M_a \quad (7)$$

where $$M_a = \frac{8Z_o}{3C} a^3 = \frac{8}{3} \rho_o a^3 \quad (8)$$

$M_a$ is representative of a mass which is independent of frequency. This mass $M_a$ is a mass added to one surface of the diaphragm and called an additional mass of air, which represents an amount of inertia to which the diaphragm is subject when it causes air to vibrate. For a loudspeaker in an infinite baffle, the amount of inertia is doubled. The relation indicated by Equation (7) is substantially valid for a lower frequency band represented by ka<1 but for a higher frequency band of ka>1, the radiation reactance $X_r$ gradually decreases as shown in FIG. 3, followed by a decrease in $M_a$.

On the other hand, for the band of ka<1 within a mass controllable region satisfying $f>f_o$, $f_o$ being a minimum resonance frequency, an output sound pressure level (SPL) is determined by, $$SPL = C_o + 20 \log \frac{B\, la^2}{M_o \sqrt{Z_s}} \quad (9)$$

where $C_o$: constant

B: magnetic flux density at magnetic gap l: length of voice coil $M_o$: effective mass of vibration member ($M_o=M_d+M_v+M_a+\ldots$)

$Z_s$: electrical impedance of voice coil.

In $M_o$, $M_d$ designates a mass of the diaphragm, $M_v$ a mass of the voice coil and $M_a$ an additional mass of air. For the lower frequency band of ka<1, the additional mass of air $M_a$ is substantially constant as represented by Equation (8) but for the higher frequency band of ka>1, the additional mass of air gradually decreases as described previously in accordance with the following equation:

$$M_a = \pi \rho a^3 \frac{S_1(2ka)}{2(ka)^3} \quad (10)$$

For a high frequency band as represented by ka>5, $$R_r \approx \pi a^2 Z_o \quad (11)$$

$$X_r \approx 0 \quad (12)$$

are held and $M_a \approx 0$ results. This explains that the bounce h, leading to degraded tone quality which gives uncomfortable feeling to hearing, occurs in the output sound pressure/frequency characteristics as shown in FIG. 2. From Equation (9), the bounce h is indicated by $$h = 20 \log \frac{M_o}{M_o - M_a}. \quad (13)$$

When a diaphragm is designed to have a 1.3 cm×5 cm rectangular configuration, an additional mass of air $2M_a$ of about 15 mg and a mass $M_d$ of 7 mg, bounce characteristics of a loudspeaker using this diaphragm are calculated for a voice coil having a mass $M_v$ of 21 mg and another voice coil having a mass $M_v$ of 7 mg. The smaller the mass $M_v$ of voice coil, the greater the bounce h becomes. This means therefore that the smaller the mass $M_o$ of vibration member, the greater the bounce h becomes. The article previously described proposes an expedient for elimination of the bounce h, according to which a horn 2 is disposed in front of a diaphragm 1 as shown in FIG. 4 to thereby flatten the sound pressure/frequency characteristics. However, since $M_a$ is proportional to the cube of effective radius a of the diaphragm, the bounce h increases as the diaphragm increases in size.

Take, for instance, an all band type loudspeaker of a diameter of 30 cm which is dimensioned such that a=12 cm, $M_a$=11 g, $M_d$=0.8 g, film thickness t=12 μm, $M_v$=2.6 g, aluminum foil thickness=20 μm and $M_o \approx 14.4$ g. In this loudspeaker, a bounce h occurs which amounts up to about 12 dB as shown in FIG. 5. If an attempt is made to eliminate this amount of bounce with the expedient of the aforementioned article wherein the horn is disposed in front of the diaphragm to flatten the sound pressure/frequency characteristics, then the horn mouth length of more than 1.5 m longitudinal length which is practically unacceptable.

For the reasons set forth previously, the diaphragm is mainly used for tweeters.

It is particularly important to note that the additional mass of air $M_a$ is in proportion to the cube of the effective radius a of the diaphragm with the result that as the diaphragm increases in size, the bounce h becomes large correspondingly.

Incidentally, for the high frequency band of ka>5 described previously, $R_r$ and $X_r$ are given by Equations (11) and (12), indicating that directivity becomes so sharp that radiation of sound is confined in the front of the diaphragm and hence approximates a plane wave.

A directivity characteristic is determined by the following equation:

$$R_\theta = \frac{2J_1(ka \sin\theta)}{ka \sin\theta} \quad (14)$$

where $R_\theta$ is a ratio between an on-axis sound pressure and a sound pressure in a direction making an angle $\theta$ to the axis. Thus, the angle between the axis of the diaphragm and the projection of the line joining the center of a measuring point and the origin of the axis is $\theta$. There are illustrated in FIG. 6 a sound pressure/frequency characteristic for $\theta$=30° as represented by a dashed curve (b) and that for $\theta$=60° as represented by a dashed and dotted curve (c).

As will be seen from FIG. 6, with a larger diaphragm, sharpness of the directivity becomes eminent at a lower frequency.

Japanese Patent Unexamined Publication No. 55-25265, published on Feb. 22, 1980, discloses a loudspeaker having a plurality of voice coils wound on a single bobbin as shown in FIG. 7. The loudspeaker generally designated at 3 in FIG. 7 comprises a voice coil 4 for reproduction over all band or range, and a voice coil 6 cooperative with a low-pass filter 5 for reproduction of signals at 200 Hz or less. This loudspeaker provides sound pressure/frequency characteristics as graphically shown in FIG. 8 wherein reproduction pursuant to a characteristic (d) is obtained by the voice coil 4, reproduction pursuant to a characteristic (e) is obtained by the voice coil 6, and reproduction pursuant to a composite characteristic (f) which is emphasized for 200 Hz or less is obtained by both the voice coils 4 and 6.

This loudspeaker 3 also has an electrical impedance pursuant to a characteristic (g) wherein the electrical impedance $Z_s$ falls below a predetermined value, for example, 8 Ω as the frequency decreases below 200 Hz because the voice coils 4 and 6 are driven in parallel. Further, an inductance attributable to the winding of the voice coils causes the electrical impedance $Z_s$ to increase as the frequency increases, bringing about a snaky electrical impedance characteristic as represented by the characteristic (g). Because of this electrical impedance characteristic, a power amplifier for driving the loudspeaker tends to suffer from unstable operations.

SUMMARY OF THE INVENTION

This invention intends to solve the prior art problems and has for its object to provide a loudspeaker based on a single diaphragm which can effect reproduction over all range, flatten sound pressure/frequency characteristics, improve sound image localization, improve directivity characteristics to provide wide directional frequency characteristics, and improve transient characteristics.

To accomplish the above object, according to this invention, a plurality of voice coils are formed on one surface, front or back, or on both surfaces of a diaphragm in a multi-layer fashion. The voice coils respectively for a high band side i.e., tweeter side and a low-band side i.e., woofer side are connected to a dividing network and driven in a multi-drive fashion by driving forces which are weighted relative to each other, so as to raise sound pressure levels in the low band in the conventional sound pressure/frequency characteristic and lower sound pressure levels in the high band, thereby to obtain a flat sound pressure/frequency characteristic.

In addition, to improve the directivity characteristic, the voice coil for the high band, i.e., tweeter voice coil is so configured that the drive force generated in the tweeter voice coil is not transmitted to the entirety of the diaphragm but is transmitted to, for example, ½, ⅓ --- of the entire area of the diaphragm. With this construction, the effective radius or equivalent radiation area can be reduced and therefore a wide directional frequency characteristic can be obtained.

BRIEF DESCRIPTION OF THE DRAWINGS

FIGS. 2 to 8 are diagrams for explaining prior arts, wherein FIG. 2 is a graph showing sound pressure/frequency characteristics of a prior art loudspeaker.

FIG. 3 is a graph showing a radiation impedance characteristic of a piston disc.

FIG. 4 is a schematic sectional view showing the construction of a loudspeaker capable of providing an improved characteristic over the FIG. 2 characteristic.

FIG. 5 is a graphical representation showing an example of a calculated sound pressure/frequency characteristic.

FIG. 6 shows conventional sound pressure/frequency characteristics.

FIG. 7 is a circuit diagram showing the connection of components of a prior art loudspeaker, and FIG. 8 is a graph showing characteristics of the FIG. 7 loudspeaker;

DESCRIPTION OF THE PREFERRED EMBODIMENTS

The invention will now be described by way of example with reference to the accompanying drawings.

EMBODIMENT 1

Figure 10:
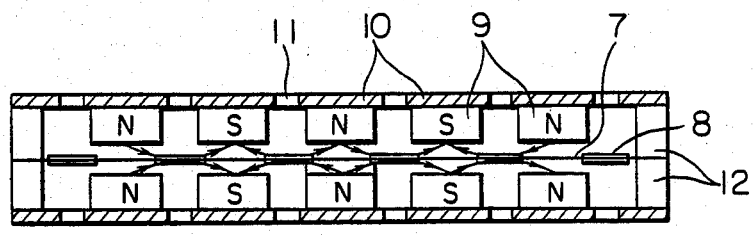
FIG. 10 is a schematic sectional view showing a loudspeaker structure according to an embodiment of the invention.

FIG. 10 shows a loudspeaker structure embodying the invention which incorporates a means for raising sound pressure levels in a low band.

Referring to FIG. 10, the loudspeaker structure comprises a thin film vibratory diaphragm 7, a plurality of voice coils of electroconductive films formed on both surfaces of the diaphragm 7 in a multi-layer fashion, a plurality of magnetized columnar magnets 9, and yoke plates 10 associated with the magnets. Sound wave radiation holes 11 are formed in the yoke plates 10. The above component parts are put together by means of frames 12.

Figure 1:
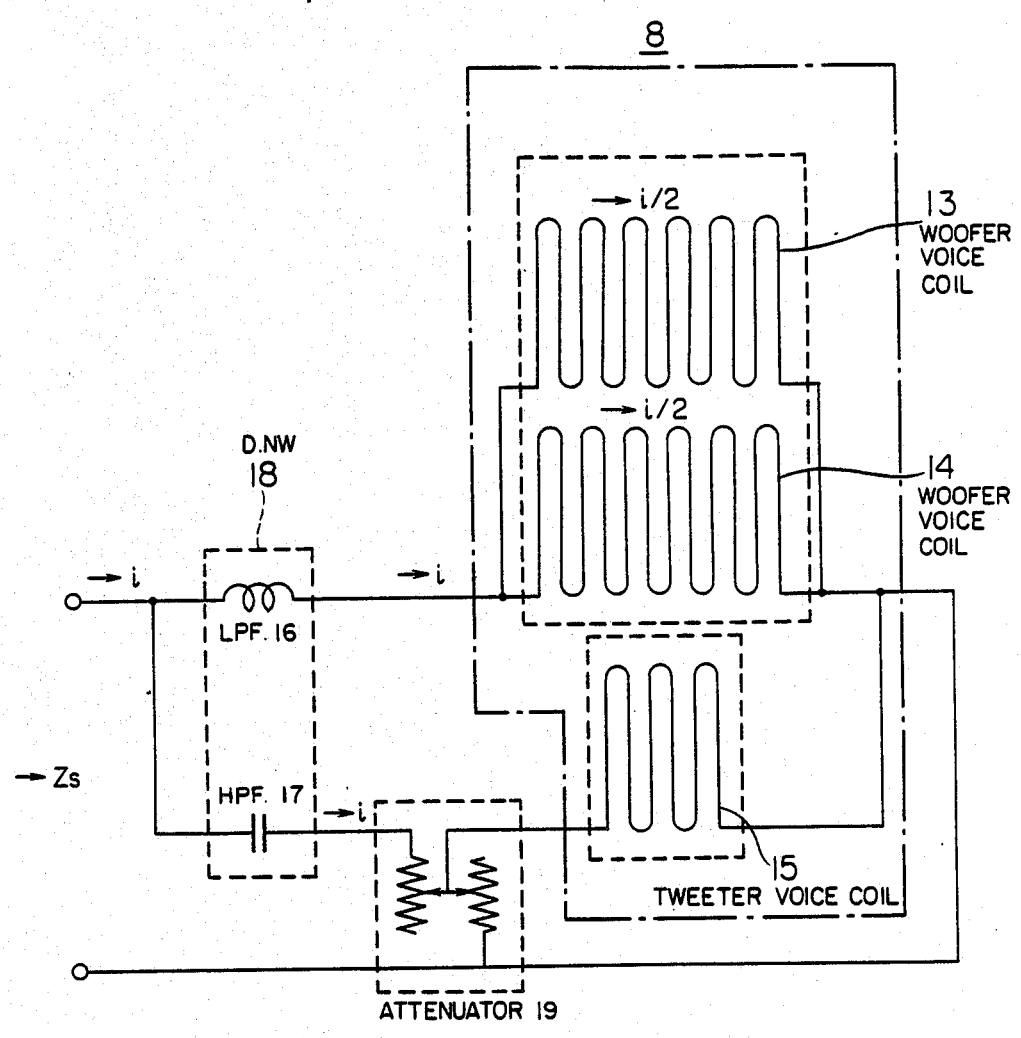
FIG. 1 is a circuit diagram showing the connection of components such as voice coils and a dividing network of a loudspeaker system according to an embodiment of the invention.
Figure 2:
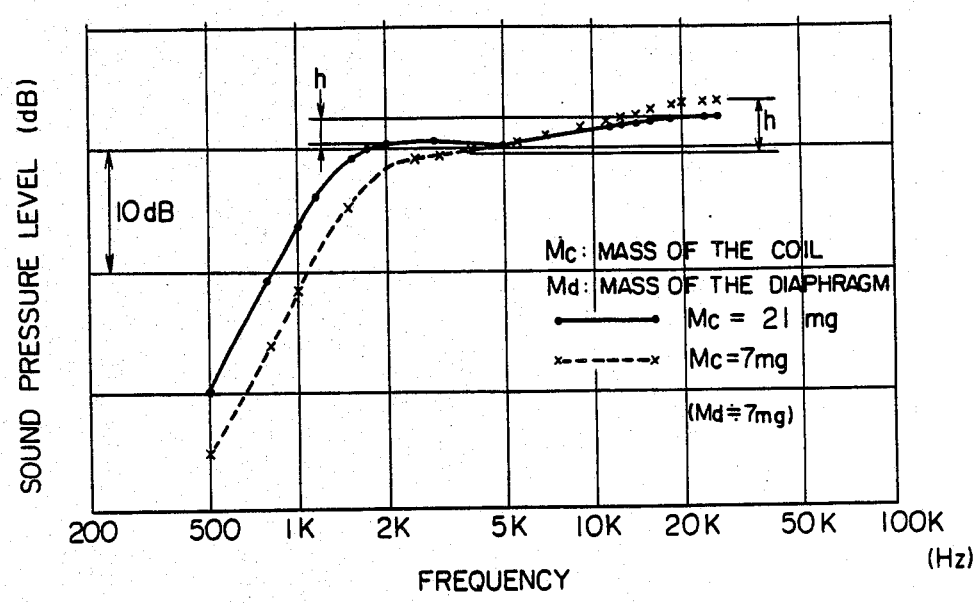
FIG. 2 PRIOR ART
Figure 4:
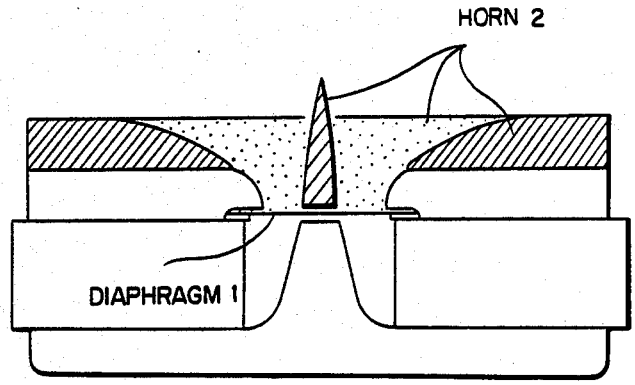
FIG. 4 PRIOR ART
Figure 3:
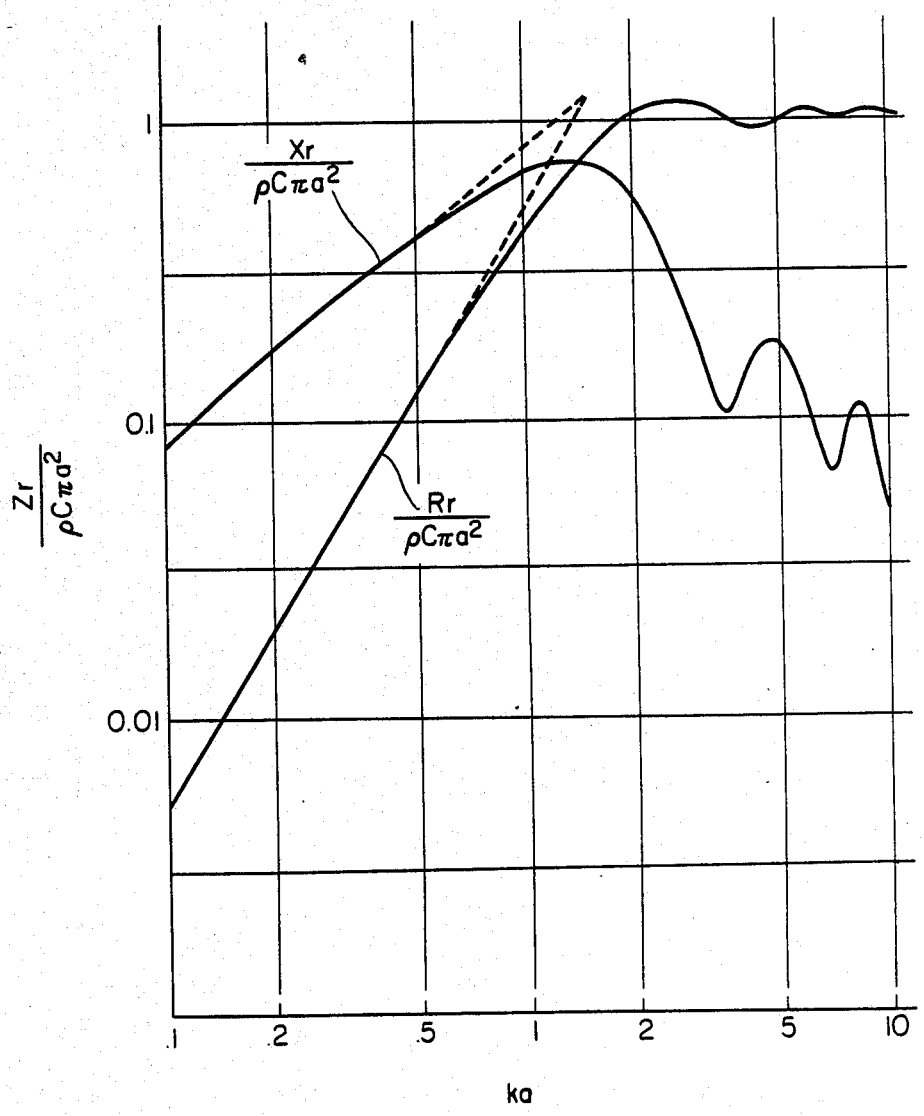
FIG. 3 PRIOR ART
Figure 5:
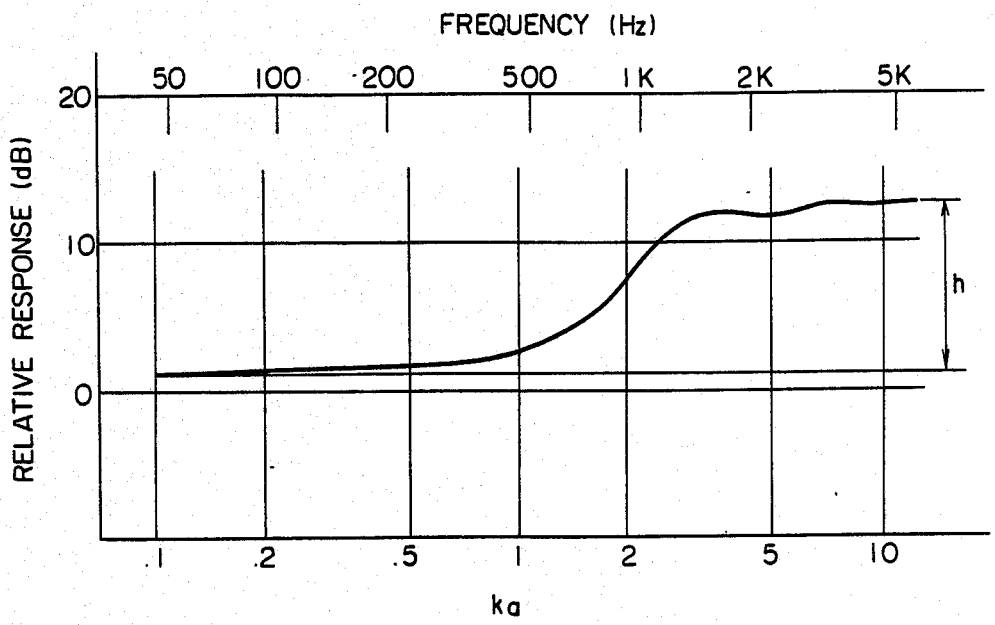
FIG. 5 PRIOR ART
Figure 6:
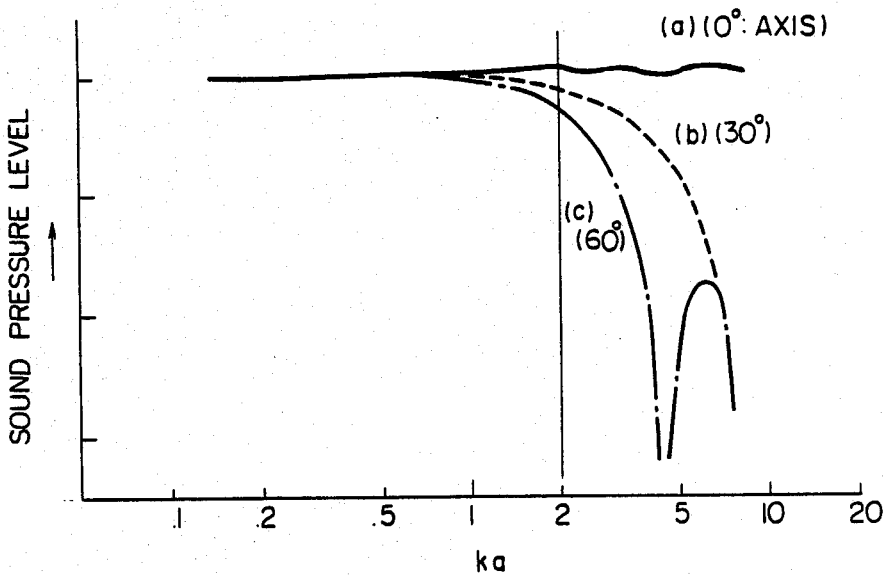
FIG. 6 PRIOR ART
Figure 7:
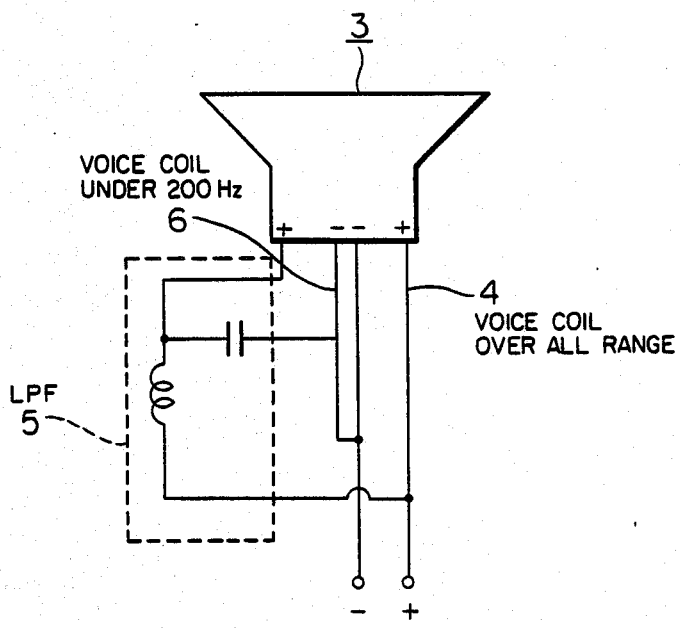
FIG. 7 PRIOR ART
Figure 8:
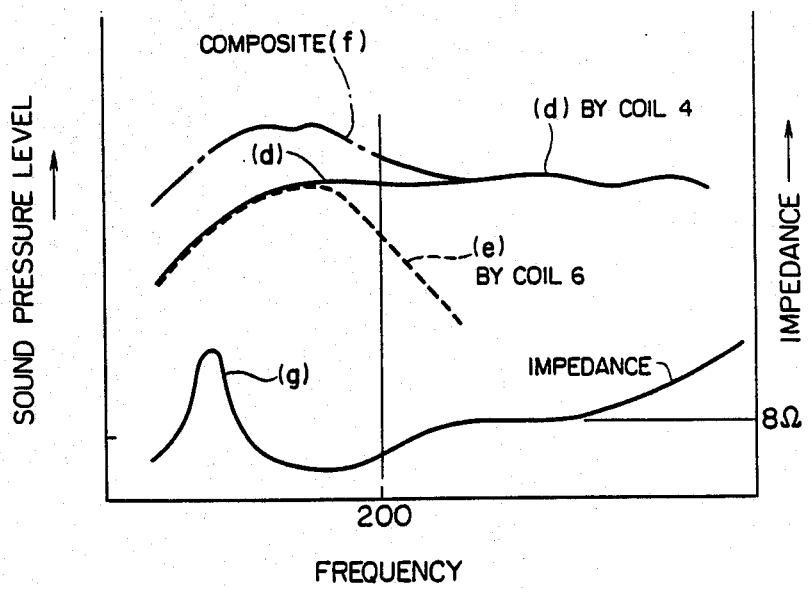
FIG. 8 PRIOR ART
Figure 9:
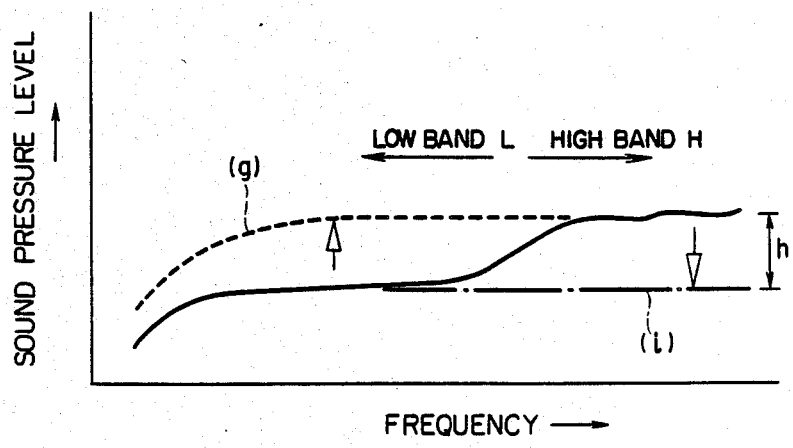
FIG. 9 is a graphical representation of sound pressure/frequency characteristics useful to explain the principle on which the invention is based to solve the prior art problems.
Figure 11:
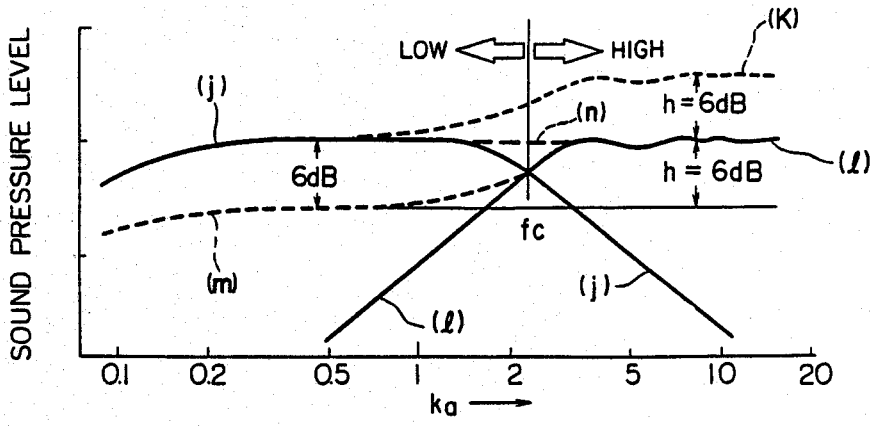
FIG. 11 is a graphical representation useful to explain flattening of sound pressure/frequency characteristics in the loudspeaker of the invention achieved by raising sound pressure levels in a low band and lowering sound pressure levels in a high band.

FIG. 1 shows a loudspeaker system embodying the invention which comprises a plurality of multi-layer voice coils, and a dividing network connected to the voice coils. A voice coil circuitry generally designated at 8 includes three voice coils 13, 14 and 15. The dividing network (DNW) 18 includes a low-pass filter (LPF) 16 and a high-pass filter (HPF) 17. An attenuator 19 is connected between the dividing network 18 and the voice coil 15. An audio input terminal is connected to a parallel connection of the voice coils 13 and 14 through the low-pass filter 16 and to the voice coil 15 through the high-pass filter 17 and attenuator 19. For simplicity of explanation of the raising means according to the invention, it is assumed that the bounce is 6 dB and sound pressure levels in a low-band are to be raised by 6 dB. It is then also assumed that the electrical impedance $Z_s$ as viewed from the input terminal of the system is 8 Ω, the tweeter voice coil 15 has a corresponding impedance of 8 Ω, and the woofer voice coils 13 and 14 have each a length 2l which is twice a length l of the tweeter voice coil 15 and consequently, an impedance of 16 Ω. When a signal current i is supplied to the input terminal of the loudspeaker system, a driving force, F=Bli, is generated in the voice coil 15. Since, on the other hand, a current of i/2 is passed through each of the voice coils 13 and 14, a resultant driving force, $F=2\times(B\times 2l\times i/2)=2Bli$, is generated in these two coils. This resultant driving force for the woofer voice coils is 6 dB higher than the driving force for the tweeter voice coil. Consequently, as shown in FIG. 11, a sound pressure/frequency characteristic (j) for the low-band can be obtained by passing the signal current through the low-pass filter 16 (unless the signal current is passed through the low-pass filter 16, a dashed characteristic (k) will be obtained). In addition, by passing the signal current through the high-pass filter 17, a sound pressure/frequency characteristic (l) for the high band can be obtained (unless the signal current is passed through the filter 17, a dashed characteristic (m) will be obtained). By combining the characteristics (j) and (l), a composite sound pressure/frequency characteristic (n) can be obtained which is flat over all the range.

Where the bounce h exceeds 6 dB, the length l is increased by increasing the number of the woofer voice coils correspondingly or by increasing the cross-sectional area of the voice coils 13 and 14. Alternatively, the sound pressure levels in the high-band may be decreased using the attenuator 19.

Where the bounce h is below 6 dB, the electrical impedance of each of the voice coils 13 and 14 is maintained at 16 Ω while the length of each voice coil is decreased (by decreasing the cross-sectional area of the electroconductive film to keep the electrical impedance), thereby ensuring matching with the sound pressure levels in the high band.

Where the electrical impedance as viewed from the input terminal of the loudspeaker system is not 8 Ω, specifications of the voice coils are changed so as to conform to the value of the electrical impedance. A crossover frequency $f_c$ of the dividing network 18 is selected to be 1.5 to 2.5 in terms of ka.

While in the prior art example, the sound pressure levels can be raised only in a limited range of 200 Hz or less and a decrease in the electrical impedance is inevitable, the present invention can ensure that the sound pressure levels can be raised to obtain flatness over a wide range. As a result, the sound pressure/frequency characteristic and the electrical impedance characteristic can be flattened over all the range.

EMBODIMENT 2

Figure 12:
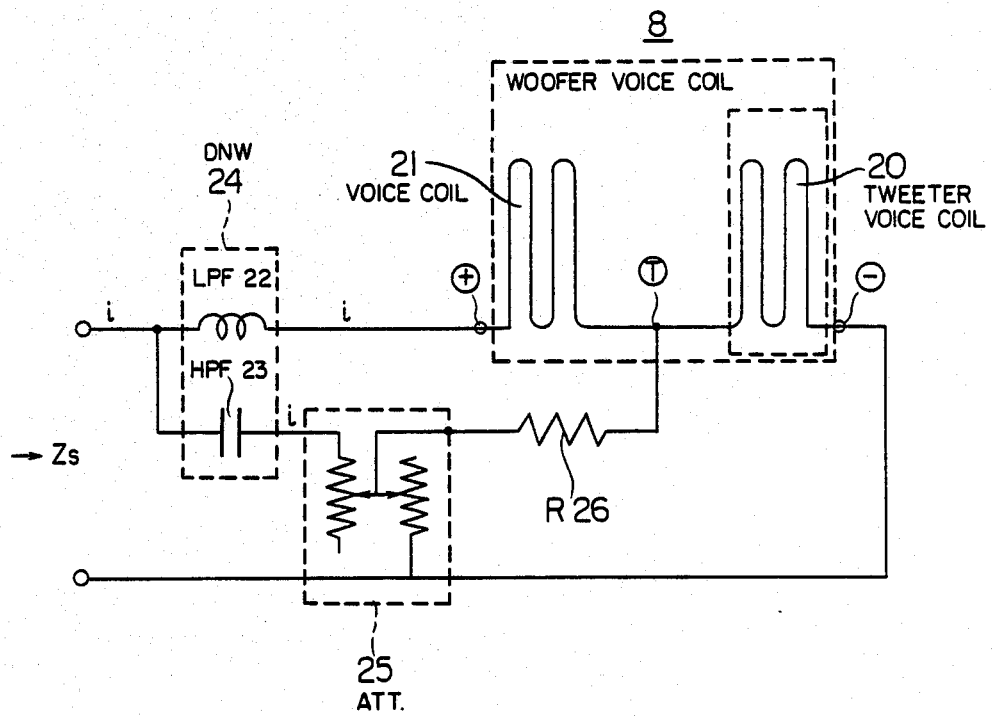
FIG. 12 is a circuit diagram showing the connection of components of a loudspeaker system according to another embodiment of the invention.

This embodiment comprises a means for decreasing sound pressure levels in a high band. FIG. 12 shows a loudspeaker system which comprises, like the FIG. 1 system, a plurality of multi-layer voice coils, and a dividing network connected to the voice coils. A voice coil circuitry 8 in FIG. 12 includes two voice coils 20 and 21. The dividing network 24 includes a low-pass filter 22 and a high-pass filter 23. Reference numeral 25 designates an attenuator, and 26 a resistor which is cooperative with the voice coil 20 to provide a resultant electrical impedance $Z_s$ of 8 Ω. An input terminal is connected to a series connection of the voice coils 20 and 21 through the low-pass filter 22 and to a junction T between the voice coils 20 and 21 through the high-pass filter 23, attenuator 25 and resistor 26, respectively. The voice coils 20 and 21 are patterned on a diaphragm 7 as exemplified in FIGS. 13A and 13B. Thus, the voice coils 20 and 21 are juxtaposed in zigzag form on one surface of the diaphragm 7 structurally shown in Fig. 10. These voice coils 20 and 21 may also be formed on both surfaces of the diaphragm 7 in the same manner.

Figure 14:
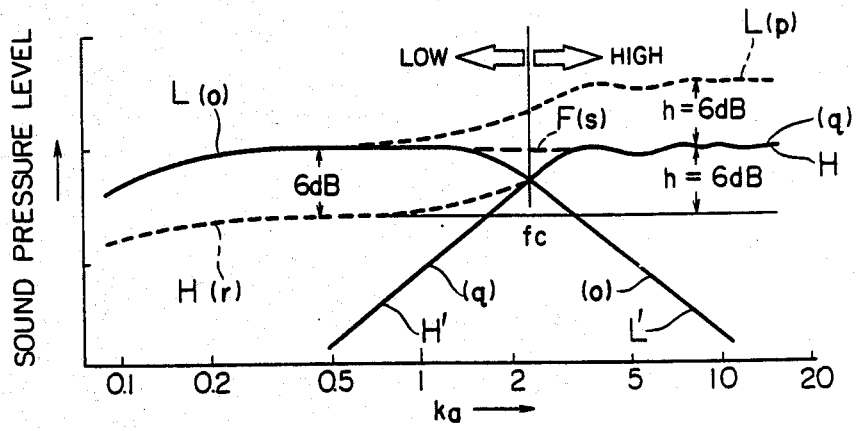
FIG. 14 is a graphical representation similar to FIG. 11 and applied to the FIG. 12 system.

For simplicity of explanation of the reduction means according to the invention, it is assumed that the bounce is 6 dB and the sound pressure levels in the high band are to be reduced by 6 dB. It is then also assumed that the electrical impedance $Z_s$ as viewed from the input terminal of the system is 8 Ω, the voice coils 20 and 21 connected in series each have the same length l and an impedance of 4 Ω, and the resistor 26 is of 4 Ω. Since an audio signal current i passed through the low-pass filter 22 flows in the tweeter and woofer voice coils 20 and 21, a resultant driving force, $F=B\times 2l\times i=2Bli$, is generated in both the coils. On the other hand, an audio signal current passed through the highpass filter 23 flows in the tweeter voice coil 20 alone to generate a driving force, F=Bli, which is lower by 6 dB than the resultant driving force. Consequently, as shown in FIG. 14, a sound pressure/frequency characteristic (o) for the low-band can be obtained by passing the signal current through the low-pass filter 22 (unless the signal current is passed through the low-pass filter 22, a dashed characteristic (p) will be obtained). In addition, by passing the signal current through the high-pass filter 23, a sound pressure/frequency characteristic (q) for the high band can be obtained (unless the signal current is passed through the filter 23, a dashed characteristic (r) will be obtained). By combining the characteristics (o) and (q), a composite sound pressure/frequency characteristic (s) can be obtained which is flat over all the range. Further, the 4 Ω electrical impedance of the voice coil 20 is added with the resistance of the resistor 26 to provide a resultant impedance of 8 Ω so that the electrical impedance $Z_s$ as viewed from the input terminal of the loudspeaker system never falls below 8 Ω.

In this manner, in the all band type loudspeaker system wherein the voice coils 20 and 21 are simply connected in series to provide the electrical impedance $Z_s$ of 8 Ω and the bounce in the sound pressure/frequency characteristic is 6 dB, a flat sound pressure/frequency characteristic can be obtained over all the audio frequency range.

Where the bounce h exceeds 6 dB, it is conceivable to increase the length of the voice coil 21 (with its impedance increased above 4 Ω), decrease the length of the voice coil 20 (with its impedance decreased below 4 Ω) and increase the resistance of the resistor 26 above 4 Ω so that the resultant impedance of 8 Ω can be maintained; or alternatively, it is also conceivable to lower the sound pressure levels in the high band by adjusting the attenuator 25.

Where the bounce h is below 6 dB, in contrast to the precedence, the length of the voice coil 21 may be decreased (with its impedance decreased below 4 Ω), the length of the voice coil 20 may be increased (with its impedance increased above 4 Ω), and the resistance of the resistor 26 may be decreased below 4 Ω to maintain the resultant impedance of 8 Ω.

In this manner, according to this embodiment, the flat sound pressure/frequency characteristic can be obtained.

EMBODIMENT 3

Figure 15:
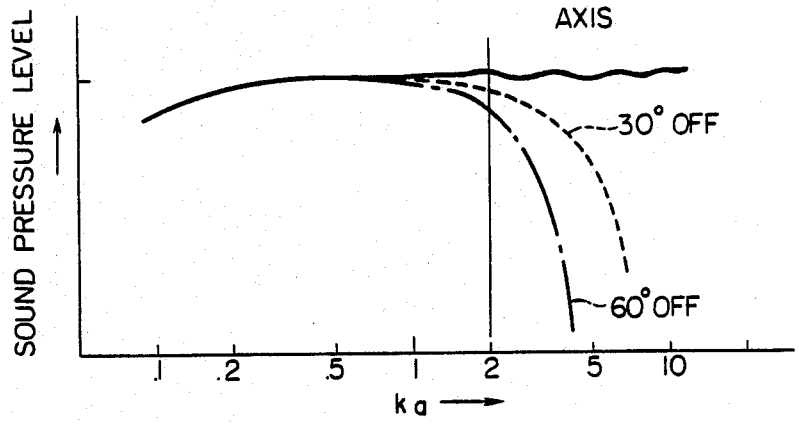
FIG. 15 is a graph showing directivity characteristics of the diaphragm.

This embodiment is directed to an improvement in directivity characteristic in the loudspeaker system described in connection with the embodiment 2. Since in the embodiment 2 the tweeter voice coil 20 also acts as a woofer voice coil, the voice coils 20 and 21 having each the same length l (the same electrical impedance) are arranged in parallel or juxtaposed over the entire area of the diaphragm 7 (in FIGS. 13A and 13B) in order to transmit the driving force F to the entirety of the diaphragm 7. This can afford to provide the flat sound pressure/frequency characteristic but with this construction, the directivity characteristic is determined by the diameter of the diaphragm 7 and considerably degraded in 30° and 60° off-axis directions in a high frequency band represented by ka >2, as shown in FIG. 15. It follows therefore that in off-axis directions deviating from the front axis of the loudspeaker, tone quality comes short of high-band sounds.

Figure 13A:
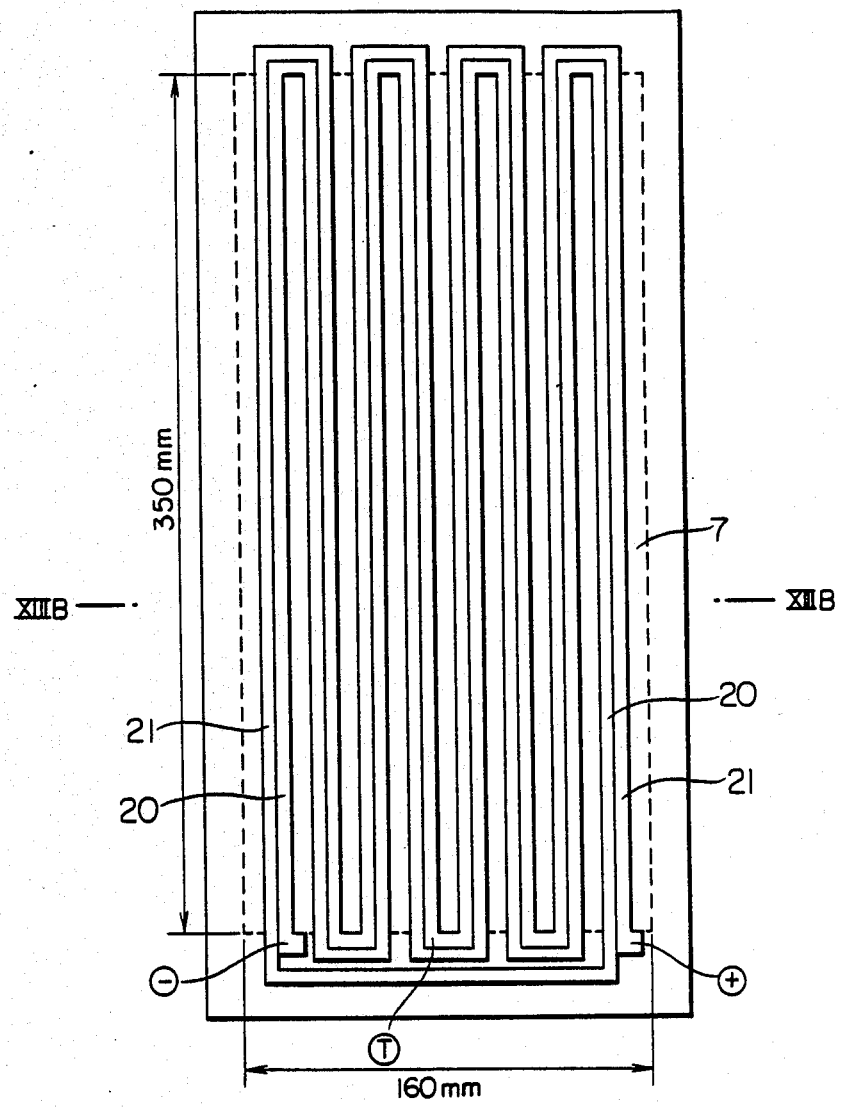
FIG. 13A is a plan view of a voice coil pattern on a diaphragm used, in the FIG. 12 loudspeaker system.
Figure 13B:
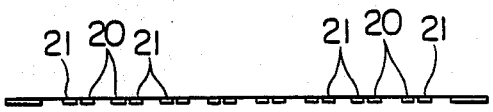
FIG. 13B is a section of FIG. 13A.
Figure 16A:
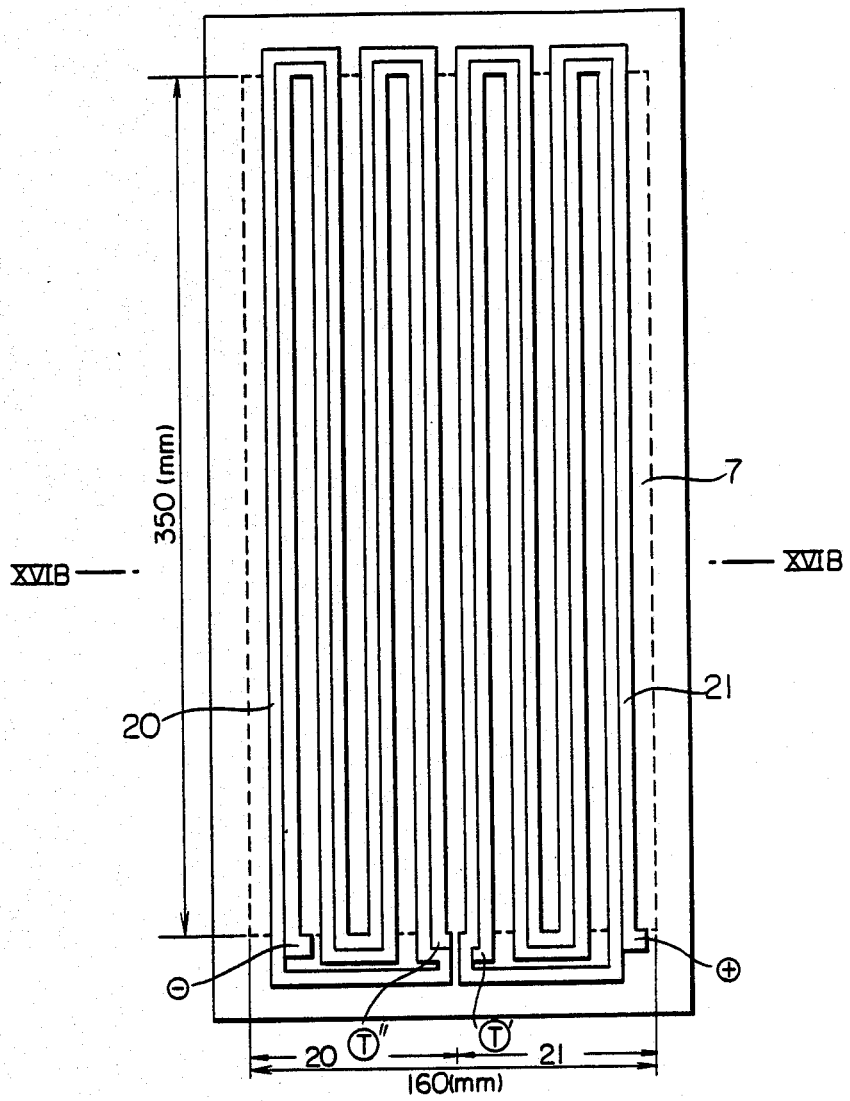
FIG. 16A is a plan view showing another embodiment of a voice coil pattern.
Figure 16B:
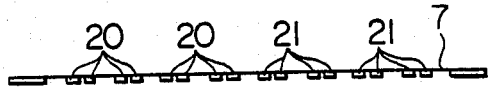
FIG. 16B is a section of FIG. 16A.

In order to improve the directivity characteristic, a radiation area S (equivalent to effective radius a) may conveniently be reduced. To this end, in contrast to the patterning of the tweeter voice coil 20 over the entire area of the diaphragm 7 as shown in FIGS. 13A and 13B, a tweeter voice coil 20 in this embodiment is patterned over half the area of a diaphragm 7 as will be seen from FIGS. 16A and 16B. Specifically, the end of winding, designated at T', of a voice coil 21 and the beginning of winding, designated at T'', of the voice coil 20 are connected together through a jumper wire or at the back of the voice coil. A loudspeaker structure based on this system is illustrated in sectional form in FIG. 17. As shown, the diaphragm 7 is uniformly stretched by means of members G-1, G-2 and G-3 formed of glass wool. In particular, the member G-2 serves to prevent vibrations generated in the voice coil 20 from being transmitted to a portion of the diaphragm on which the voice coil 21 is formed. The members G-1 and G-2 serve as supports for voice coils.

The following description will be given on the assumption that the component parts of the loudspeaker system such as the voice coils and dividing network are connected together in the same manner as the FIG. 12 system. It is also assumed that the bounce is 6 dB.

To lower sound pressure levels in a high band by 6 dB under a condition that the electrical impedance $Z_s$ as viewed from the input terminal of the loudspeaker system is 8 Ω, the voice coils 20 and 21 having each the same length l are formed on the diaphragm 7 and connected in series with each other, as in the system of FIG. 12. Each of the voice coils 20 and 21 has an electrical impedance of 4 Ω and the resistor 26 is of 4 Ω. These voice coils 20 and 21 are positioned in a magnetic gap of magnetic flux density of B.

When a signal current i is supplied to the input terminal of the loudspeaker system, a signal current for the low-band flows in the two voice coils 20 and 21 to generate a resultant driving force, $F=B\times 2l\times i=2Bli$. On the other hand, a signal current for the high band flows in the voice coil 20 alone to generate a driving force, $F=Bli$, which is lower by 6 dB than the resultant driving force. In this embodiment, however, the mass of the diaphragm 7 is equally shared by the two voice coils each occupying half the entire area of the diaphragm and hence the effective mass $M_o$ of the vibration member is considered to be approximately halved as compared to that of the FIG. 13 system. Further, when considering that the tweeter voice coil has a radiation area which is half that of the diaphragm, it will be seen from Equation (11) that the sound pressure levels in the high band become decrease by 6 dB than those in the low band.

Figure 17:
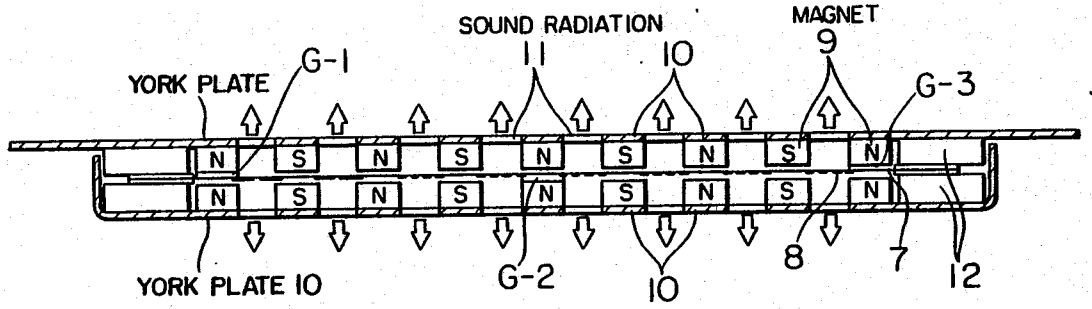
FIG. 17 is a schematic sectional view showing another embodiment of a loudspeaker structure incorporating the voice coil pattern as shown in FIGS. 16A and 16B.
Figure 18:
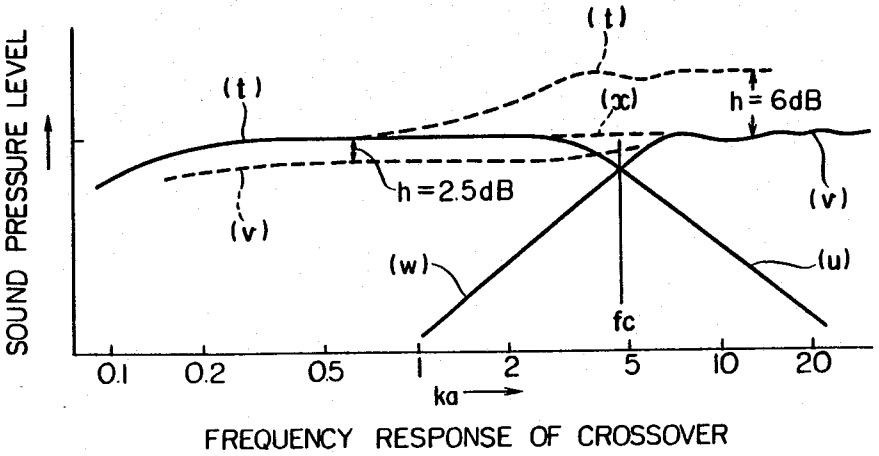
FIG. 18 is a graph showing a sound pressure/frequency characteristic obtained from the FIG. 17 loudspeaker structure.
Figure 19:
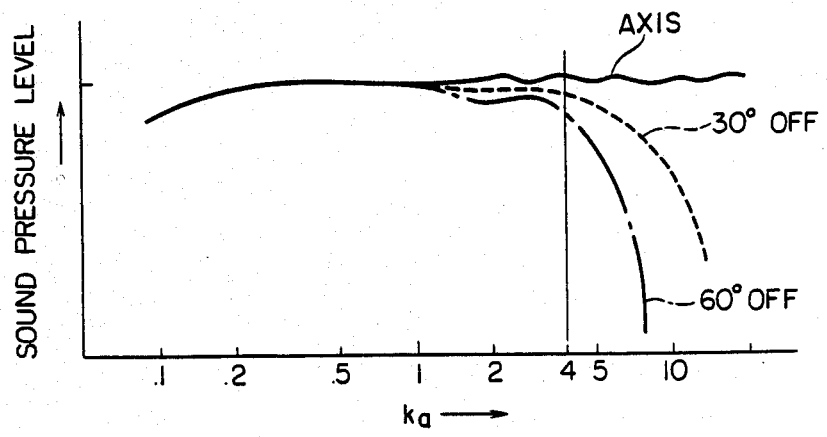
FIG. 19 is a graphical representation for explaining a directivity characteristic obtained from the FIG. 17 loudspeaker structure.

Consequently, as shown in FIG. 18, the voice coils 20 and 21 permit a sound pressure/frequency characteristic (t) for the low band (when the signal current is passed through the low-pass filter 22, a solid-line characteristic (u) will be obtained). In addition, the voice coil 20 permits a sound pressure/frequency characteristic (v) for the high band (when the signal current is passed through the high-pass filter 23, a solid-line characteristic (w) will be obtained). FIG. 18 also indicates that the sound pressure/frequency characteristic (v) for the high band is not only suppressed by 6 dB in terms of sound pressure level in comparison with the sound pressure/frequency characteristic (q) for the high band shown in FIG. 14 but also shifted by one octave toward the high frequency range. It is further noted that the halved area of the diaphragm and consequent reduction of the additional mass of air $M_a$ by ⅛ decreases the sound pressure level by about 2.5 dB in the lower frequency range. By combining the characteristics (u) and (v), a composite flat sound pressure/frequency characteristic (x) can be obtained over all the range. In this embodiment, the dividing network has a crossover dividing frequency $f_c$ which is selected to be 2 to 7 in terms of ka. Under this condition, directivity characteristics as shown in FIG. 19 are obtained wherein because of the halved radiation area of the diaphragm 7, 30° off-axis characteristic and 60° off-axis characteristic are improved over those obtained from the embodiment 2 shown in FIG. 15 so that the sharpness of directivity is relieved until a one octave higher range. To block transmission of the driving force F for the high band generated by the voice coil 20 to the entirety of the diaphragm 7, the member G-2, for example, a glass wool mat may conveniently be disposed in the center of the diaphragm 7 as shown in FIG. 17. The same effects as in the precedence may be attained by a converse disposition of the voice coils 20 and 21.

Further, the 4 Ω electrical impedance of the voice coil 20 may be added with the resistance of resistor 26 to provide a resultant impedance of 8 Ω so that the electrical impedance $Z_s$ never falls below the predetermined value.

Where the bounce h exceeds 6 dB, it is conceivable, as idance $Z_s$ never falls below the predetermined value.

Where the bounce h exceeds 6 dB, it is conceivable, as in the embodiment 2, to increase the length of the voice coil 21 (with its impedance increased above 4 Ω), decrease the length of the voice coil 20 (with its impedance decreased below 4 Ω) and increase the resistance of the resistor 26 above 4 Ω so that the resultant impedance of 8 Ω can be maintained; or it is otherwise conceivable to decrease the area of the diaphragm 7 on which the voice coil 20 is formed to thereby reduce an equivalent radiation area. Especially, with the latter measure, the directivity characteristic can further be improved.

Where the bounce h is below 6 dB, in contrast to the precedence, it is conceivable as in the embodiment 2 to decrease the length of the voice coil 21 (with its impedance decreased below 4 Ω) and increase the length of the voice coil 20 (with its impedance increased above 4 Ω); or alternatively, the area of the diaphragm 7 on which the voice coil 20 is formed (radiation area) may be changed to conform with the bounce h. Needless to say, the crossover frequency $f_c$ should then be changed correspondingly.

In this manner, in the all band type loudspeaker system wherein the voice coils 20 and 21 are simply connected in series (thus being equivalent to a single voice coil) to provide the electrical impedance $Z_s$ of 8 Ω and the bounce in the sound pressure/frequency characteristic is 6 dB, a flat sound pressure/frequency characteristic can be obtained over all the range and the directivity characteristic can be improved.

The loudspeaker system described thus far has a mechanically and electrically two-way construction with a commonly used diaphragm but may have a three-way construction. In proportion to reduction in the radiation area S for the high-band, the directivity characteristic can be improved.

For simplicity of description, the invention has been explained using the two voice coils but the number of voice coils may be increased to more than two.

As has been described, according to the invention, the loudspeaker using the single diaphragm can be of a mechanically and electrically multi-way type over all the range which can flatten the sound pressure/frequency characteristic and improve the directivity characteristic. In addition, the electrical impedance characteristic never falls below the predetermined value Zs, for example, 8 Ω.

Consequently, the loudspeaker of this invention has an excellent sound image localization and an excellent transient characteristic, making it possible to reproduce natural tone quality. Further, stable operations of the power amplifier adapted to drive the loudspeaker can advantageously be ensured.

Obviously, teachings of the present invention may be applied to other types of loudspeaker such as cone type and dynamic type.

We claim:

1. In a loudspeaker comprising a diaphragm on which a voice coil is formed, and a magnetic circuit for supplying a DC magnetic flux which crosses said voice coil, the improvement which comprises:

a low-pass filter for receiving an input audio signal and passing only a low-band frequency component;

a high-pass filter for receiving the input audio signal and passing only a high-band frequency component;

first and second voice coil portions connected in series to constitute said voice coil; and resistor means for impedance matching connected to the output of said high-pass filter, an output signal of said low-pass filter being supplied to said first and second voice coil portions, an output signal of said high-pass filter being supplied to said second voice coil portion through said resistor means, and a resultant impedance of said resistor means and said second voice coil portion being substantially equal to an impedance of said first voice coil portion.

2. A loudspeaker according to claim 1 wherein said diaphragm is formed of a planar membrane, at least one surface of said membrane carrying a plurality of patterned voice coils, each of said voice coils includes said first and second voice coil portions have a ratio of their lengths so as to exhibit weighted driving forces for a high band and a low band when activated.

3. A loudspeaker according to claim 2 wherein a zigzag voice coil conductor is formed an said membrane, said zigzag voice coil conductor including said first and second voice coil portions, and a radiation area of said membrane is partly weighted so that said first and second voice coil portions cause the entirety of said membrane to vibrate in the low band and said second voice coil portion causes a portion of said membrane to vibrate in the high band.

4. A loudspeaker according to claim 1 wherein a ratio between the total length of said first and second voice coil portions and the length of said second voice coil portion is substantially 1:1 up to 4:1.

5. A loudspeaker according to claim 1 wherein said first and second voice coil portions are formed of a plurality of multi-layers of a zigzag conductor pattern which are formed on the entire area of a planar membrane, and a total mass of the entire voice coil said membrane is in all smaller than an additional mass of air.

6. In a planar loudspeaker structure comprising planar diaphragm means on which a voice coil of a conductor pattern is formed, and paired alternate magnetic pole means, alternately aligned in parallel with said diaphragm means, for supplying a DC magnetic flux which crosses said voice coil, the improvement wherein said conductor pattern comprises first and second zigzag conductor pattern portions electrically connected in series and geometrically juxtaposed, one end of said first zigzag conductor pattern portion being connected to a first terminal for receiving a low band component of an audioelectric signal, one end of said second zigzag conductor pattern portion being connected to a second terminal for passage of a signal inputted to said second pattern portion, and a junction between said first and second zigzag conductor pattern portions being connected to a third terminal for receiving a high band component of the audioelectric signal.

7. A planar loudspeaker structure according to claim 6 wherein a mass of said voice coil and a mass of said diaphragm means are in all smaller than an additional mass of air.

8. A planar loudspeaker structure according to claim 6 wherein said first and second zigzag conductor pattern portions are juxtaposed on substantially the entire area of a planar membrane constituting said diaphragm means.

9. A planar loudspeaker structure according to claim 6 wherein said first and second zigzag conductor pattern portions are formed on substantially the entire area of said diaphragm means by sharing half the entire area.

10. A planar loudspeaker structure according to claim 6 wherein said first and second zigzag conductor pattern portions are formed on substantially the entire area of said diaphragm means and an occupation area of said second zigzag conductor pattern portion on said diaphragm means is decreased in accordance with a difference in the output sound pressure level between a high band and a low band.

11. A planar loudspeaker structure according to claim 6 wherein said first zigzag conductor pattern portion has a multi-layer structure to enhance a driving force for a low band.

12. A planar loudspeaker structure according to claim 6 wherein said second zigzag conductor pattern portion has a multi-layer structure to enhance a driving force for a high band.

13. In a planar loudspeaker system comprising a planar membrane for formation of a diaphragm on which a voice coil of a conductor pattern is formed, and paired alternate magnetic pole means, alternately aligned in parallel with the planar diaphragm formation membrane, for supplying a DC magnetic flux which crosses said voice coil, wherein said conductor pattern comprises first and second zigzag conductor pattern portions formed on substantially the entire area of said planar diaphragm formation membrane, said first zigzag conductor pattern portion having a multi-layer structure such that respective layers are electrically connected in parallel and have opposite ends connected in common to a terminal to which a low band component of an input audio signal is applied, said second zigzag conductor pattern portion being connected to a terminal to which a high band component of the input audio signal is applied, and said first and second zigzag conductor pattern portions having each a predetermined cross-sectional area and having lengths which are in a ratio determined in accordance with a difference in the output sound pressure level between a low band and a high band.

* * * * *